United States Patent [19]

Kreis

[11] 4,050,705

[45] Sept. 27, 1977

[54] BRAKING DEVICE FOR SKI SCOOTERS

[76] Inventor: Philipp Kreis, Neumarkter Str. 34-36, 8000 Munich 80, Germany

[21] Appl. No.: 662,640

[22] Filed: Mar. 1, 1976

[30] Foreign Application Priority Data

| | | |
|---|---|---|
| Feb. 28, 1975 | Germany | 2508814 |
| Apr. 4, 1975 | Germany | 2515838 |

[51] Int. Cl.[2] ..... A63C 17/14

[52] U.S. Cl. ..... 280/11.1 BT; 280/11.2

[58] Field of Search ..... 280/11.1 BT, 11.1 R, 280/87.04 A, 87.04 R, 11.21, 11.2, 11.19, 11.23, 11.22, 11.37 B, 11.37 Z, 11.37 E; 272/97

[56] References Cited

U.S. PATENT DOCUMENTS

| | | | |
|---|---|---|---|
| 1,127,900 | 2/1915 | Kratky | 280/11.11 R |
| 1,150,966 | 8/1915 | Ries | 280/11.2 |
| 1,185,484 | 5/1916 | Cooper | 280/11.23 |
| 2,490,183 | 12/1949 | Wheeler | 280/11.37 E |
| 3,767,220 | 10/1973 | Peterson | 280/11.2 |

FOREIGN PATENT DOCUMENTS

| | | | |
|---|---|---|---|
| 1,200,727 | 12/1959 | France | 280/11.2 |
| 1,285,357 | 1/1962 | France | 280/11.37 E |
| 386,121 | 10/1922 | Germany | 280/11.23 |
| 348,806 | 7/1937 | Italy | 280/11.23 |
| 315,615 | 3/1934 | Italy | 280/11.23 |
| 17,848 | 5/1910 | United Kingdom | 280/11.23 |

*Primary Examiner*—Philip Goodman
*Assistant Examiner*—David M. Mitchell
*Attorney, Agent, or Firm*—William Anthony Drucker

[57] ABSTRACT

A known ski scooter, for use as sport and training equipment, has a foot board, on which the user's foot is secured by a binding, and sets of wheels adjacent the ends of the boards, one set being braked by a brake element linked to a brake lever formed for engagement of a ski stick in it. The invention has the brake lever as a hinged element operable by pulling it with a ski stick fitted with an engaging device, for example a rubber end member for the ski stick or a basket or a bearing ring with diametrically opposed extensions on it.

8 Claims, 11 Drawing Figures

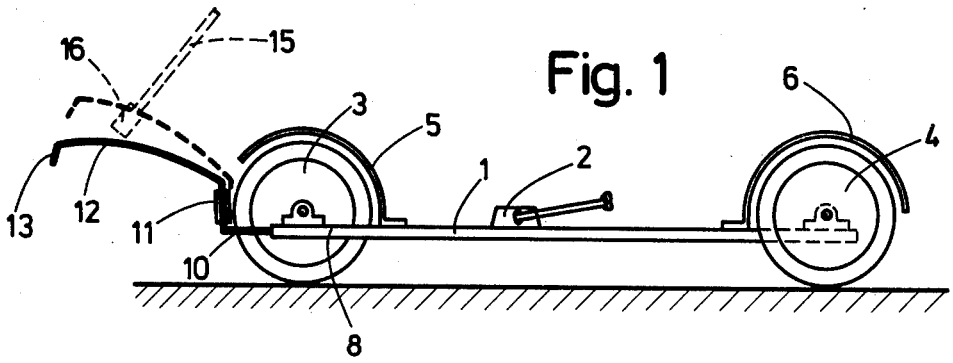
Fig. 1
Fig. 2
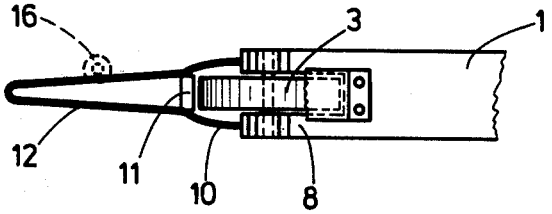
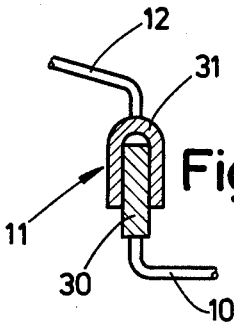
Fig.5
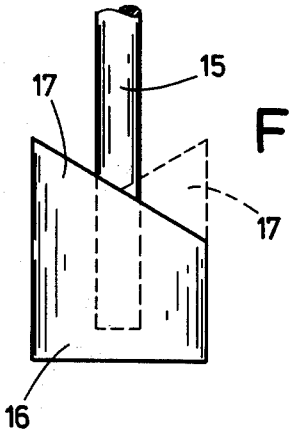
Fig.11
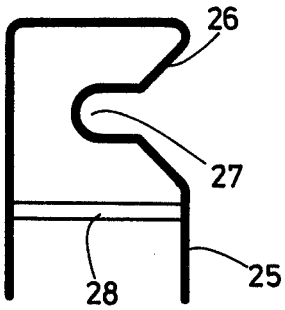
Fig.4
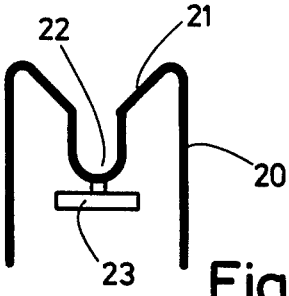
Fig.3

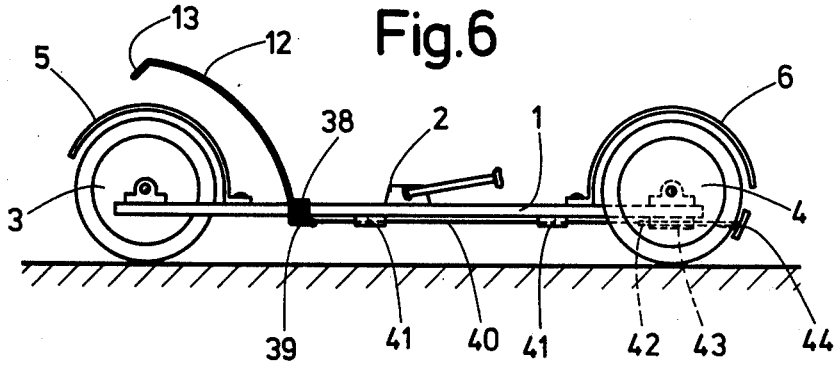
Fig.6
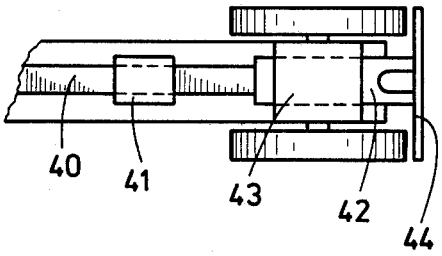
Fig.7
Fig.8
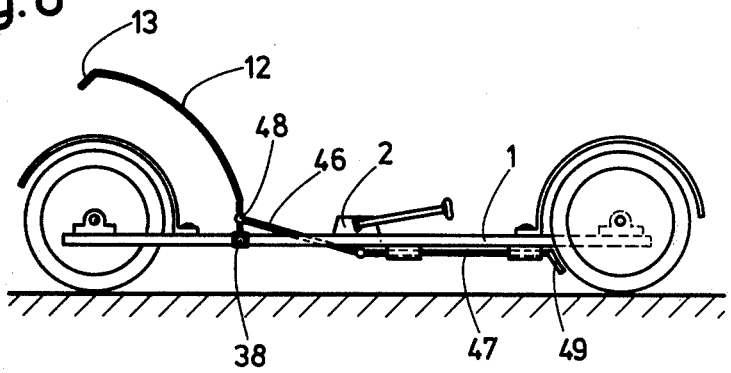
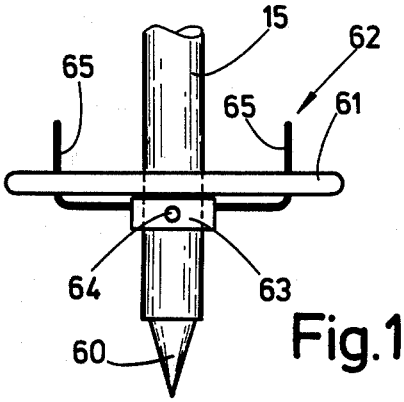
Fig.10
Fig.9
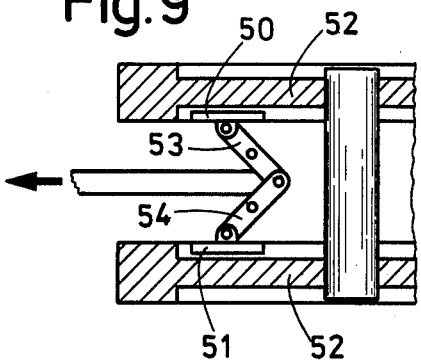

BRAKING DEVICE FOR SKI SCOOTERS

The invention relates to a braking device for ski scooters used as sport and training equipment, consisting of a foot board with a binding for securing one foot of a rider and of sets of wheels, made up of one or more wheels, located on or near the ends of the foot board, for the propulsion of which the rider uses ski sticks, the braking device having a braking element acting on one set of wheels, which is connected via a linking element to a brake lever carried on the foot board for operating the braking element, this brake lever being formed so that a ski stick engages in it.

BACKGROUND OF THE INVENTION

Ski scooters of this kind are used both as a means of travel in connection with general sporting activities and as training equipment for cross-country skiing. As level tracks are only seldom available and cross-country movement over uneven, hilly ground is more effective and enjoyable, a braking device is essential. Most known braking devices consist of brake shoes acting on the front and/or rear wheels of the ski scooter, or of brake drums, with a brake strap, fitted to these wheels. Operation of this braking device is by hand or by the rider's foot via a rod or a pull lever. In the case of one known ski scooter brake, the braking device fitted to the rear wheel of the scooter has to be operated via a rod by means of a brake lever fitted to the foot board in front of the binding. This lever can be depressed with the tip of a ski stick. This calls for great skill and great care on the part of the rider, because this brake lever is small and unfavorably located. The rider can in consequence easily lose his balance and his safety. A further disadvantage arises from the fact that the brake lever has to be pressed downwards with the ski stick. Such a pressing movement is contrary to the natural movement with which a rider reacts when travelling downhill or if a sudden hazard is encountered.

OBJECT OF THE INVENTION

With a view to overcoming these defects, the purpose of the invention is to provide an improved braking device having a brake lever which can be operated with the ski stick easily and in conformity with the natural reactive movements of the body.

SUMMARY OF THE INVENTION

In accordance with the invention, this problem is solved, in the case of a braking device for ski scooters, the braking element of which is operated by a ski stick via a brake lever, by having the brake lever in the form of a pivotted element operated by pulling with a ski stick fitted with an engaging device.

The pivotted element should preferably be in the form of a pivotted bracket pointing in the direction of travel, which can be engaged with increased certainty by the ski stick if it is shaped like a projecting curved member.

Furthermore, the engagement of the ski stick in the pivotted bracket is also ensured if the latter is fitted with an engaging slot.

It has been found to be particularly advantageous if the pivotted bracket is made from steel spring wire, because the springy resilience of the pivotted bracket suppresses any jerky movements by the rider and compensates for them, thereby preventing undesirable locking of the brake.

The pivotted bracket in accordance with the invention permits the operation of both a front wheel and a rear wheel brake. While it is true that a front wheel brake is simpler, because the pivotted bracket can also serve as a support for the braking element, none the less, a rear wheel brake has proved itself to be better from the point of view of control of movement.

The pivotted element can be operated most easily and securely with the ski stick if it is fitted either at the front end of the foot board or between the binding and the front set of wheels.

The hooking device on the ski stick can with advantage take the form of a gripping shoulder formed from a rubber end member for the stick, of a basket strengthened in its transverse position or of diametrically opposed barbed extensions.

Because of the way it is fitted and shaped, the hinged element in accordance with the invention can be gripped with a ski stick easily and with certainty, and the rider does not need to devote special attention to this action. The ski stick, when engaged, enhances the rider's hold and safety. The lever-like nature of the pivotted element, especially when it is springy, makes sensitive braking of the scooter possible, without sudden locking.

Additional details and features of the invention can be seen from the following description of examples of various versions, which are depicted in the drawing.

BRIEF DESCRIPTION OF THE DRAWINGS

FIG. 1 is a side view of a ski scooter, in diagrammatic form, with front wheel brake, FIG. 2 is a view from above of the front part of this ski scooter, FIGS. 3 and 4 are further versions of pivotted brackets, FIG. 5 is a section through a brake shoe, FIG. 6 is a side view of a ski scooter with rear wheel brake with pull rod, FIG. 7 is a view from below of the rear set of wheels thereof, slightly enlarged, FIG. 8 is a side view as in FIG. 6, but with a push rod, FIG. 9 is a view from below of the rear set of wheels, with an expanding brake shoe, FIG. 10 shows a ski stick with a gripping device and FIG. 11 shows a ski stick with a rubber end member for the stick.

THE PREFERRED EMBODIMENTS

The ski scooter shown in FIG. 1 consists of a foot board 1 with a standard cross-country binding 2, a front wheel set 3 of, for example, one running wheel and a rear wheel set 4 of, for example, two wheels. The wheels are surmounted by mudguards 5 and 6. At least one of the two sets of wheels is fitted with a known type of reverse lock. At the front, the foot board forms a forked bracket 8. Attached to the ends of this fork is a bearing rod 10 carrying a brake shoe 11. This brake shoe acts on the front running surface of the front wheel. The brake shoe bearing rod 10 extends forward as a hinged element in the form of a pivotted bracket 12, which projects forward in a curve and terminates in a nose 13. Preferably, this pivotted bracket 12 should be of spring steel and it is, as may be seen from FIG. 2, in the form of a wire loop. The brake shoe and the pivotted bracket are held downwards, and thus away from the running surface of the wheel, by their own weight. In order to bring the brake shoe into the braking position, a ski stick 15, the rubber end member 16 of which forms, for example, a gripping shoulder 17 (FIG. 11), is engaged in the pivotted bracket and, by pulling on the stick, the brake shoe 11 is forced against the running surface of the wheel (position shown by broken line in FIG. 1). As the pivotted bracket is relatively long, no skill or accuracy of aim is required to engage the stick. The curve of the pivotted bracket should preferably be such that when the stick is engaged in a position for pulling, irrespective of the point along the bracket at which it is positioned, it is as far as possible at right angles to the tangent of the bracket, thereby making it almost impossible for the stick to slip. Rider, scooter and stick thus form a triangle of forces.

Further pivotted elements are shown in FIGS. 3 and 4. A bracket 20 in FIG. 3 has a central insertion cone 21 and an engaging slot 22. The brake shoe 23 is fixed to this. The pivotted bracket 25, as shown in FIG. 4, is shaped for lateral insertion of the stick. Here, too, an insertion cone 26, with an engaging slot 27, is provided. The brake shoe takes the form of a cross-piece 28. These pivotted elements can also be extended forwards.

To prevent the forward-projecting pivotted bracket from getting in the way during transport of the scooter, it can be detachable or capable of being folded sideways, downwards or upwards by means of a joint (not shown).

A pivotted bracket extending beyond and over the front wheel increases the length of the ski scooter and thereby reduces the risk of the two separate scooters colliding with one another when the rider is moving briskly and powerfully.

FIG. 5 shows a brake shoe 11. A braking unit 31, of suitable material, such as metal or the like, is fixed on a brake cross member 30. A press fit is normally sufficient to hold the braking unit 31 in position. The braking unit is easy to replace.

In the case of the ski scooters shown in FIG. 6, the pivotted bracket 12 is secured, so that it can pivot, between the cross-country binding 2 and the front set of wheels 3 by means of a bearing pin 38 on the foot board. A draw rod or draw bar 40 is pivoted to an extension 39 of the pivotted bracket located beneath the bearing pin 38, and passes backwards through guide bushes 41 to the rear set of wheels 4. Connected to this draw bar, which is sufficiently rigid to transmit a thrust movement as well, is a slide bar 42 in a guide plate 43, to the fork-shaped end of which a braking element in the form of a braking strip 44, extending over the whole of the set of wheels, is secured, as may be more clearly seen from FIG. 7. If, in this case, the weight of the pivotted bracket is not sufficient to push the draw bar 40 and the braking strip 44 into their original position, then a tension spring (not shown) is fitted at a suitable point, e.g. to the pivotted bracket 12, to the slide bar 42 or to the draw bar 40.

To bring the braking strip 44 into the braking position, the pivotted bracket 12 is swung upwards by pulling on the engaged ski stick 15, causing the draw bar 40 to be pulled forwards and the braking strip 44 to be forced against the running surface of the rear set of wheels.

If it is desired that the braking element should operate on the front half of the rear wheel or wheels, then, as shown in FIG. 8, the hinged bracket 12 is linked by means of a toggle joint 46 to a pressure rod 47. The toggle joint engages in a pivot 48 on the pivotted bracket above the bearing pin 38, passes through the foot board 1 and transmits the movements of the pivotted bracket in rectified form to the pressure rod 47. The brake shoes 49, which can be fitted to the two rear wheels, are attached to the end of this guided pressure rod.

If the rear set of wheels is fitted with a brake drum (not shown), then it is also possible for a brake strap, which goes round the drum, to be connected to the pivotted bracket via a pull or pressure rod 40 or 47.

A further braking device operates by means of expanding shoes 50, 51 which, for example, as shown in FIG. 9, act on the inside surfaces of the wheel rims 52, intermediate levers 53, 54 providing a lever advantage and thus an increase in the braking force. The expanding shoe arrangement can be fitted for either pulling or pressing forces.

The pivotted bracket 12 can also be located nearer to the front wheel or, if the scooter is a short one, at the front end of the foot board, as in FIG. 1.

Ski sticks 15, with what are known as asphalt tips 60, usually have baskets 61 (FIG. 10). In order to strengthen these baskets to form a gripping device 62, which engages firmly and without risk of slipping in the pivotted bracket 12, a bearing ring 63 is fitted to the stick 15 below the basket. This can be done by means of clamping screws or also with a pin 64. Such a bearing ring of itself provides sufficient restriction of movement of the basket. It is also desirable for the bearing ring to carry extensions projecting upwards through the basket, on opposite sides. These extensions grip the pivotted element like barbs. They are arranged, in relation to the handle of the stick, in such a way that, during riding, one of these barbed extensions is always on the inside, that is to say, opposite the pivotted bracket. By fitting the extensions on both sides, the sticks can be changed over at any time. The bearing ring 63, with its extensions, can, of course, also be used without the basket.

Another type of engaging device consists of a runner end member 16 for the stick (FIG. 11) fitted over the stick with its front gripping shoulder, which should preferably have one, or, better, two barbs 17 opposite one another. A disc surface of adequate width surrounding the stick is of itself sufficient as an engaging device, especially if the pivotted element is provided with engaging slots, such as, for example 22, 27 (FIGS. 3 and 4).

Operation of this brake is extremely simple. As soon as the scooter reaches an undesirably high speed on a sloping surface, the rider hooks his sticks under the pivotted brackets of both scooters and brakes the scooters by an appropriately strong pull. To release the brake, all that is necessary is to let go of the pivotted brackets, whereupon the brake shoes are released. It is possible for release of the braking system to be assisted by means of supplementary tension or compression springs.

The invention is not limited to the examples of versions described. For example, other forms of pivotted brackets are feasible. They could also extend to the rear over the wheel or to the side past the wheel. An additional locking device e.g., for the pivotted bracket, with one or more notch positions, makes it possible to apply a steady braking force.

I claim:

1. In combination:

i. a ski scooter including:

a. a foot board having a front end and a rear end
b. a binding means on said footboard for securing one foot of a rider
c. first wheel means mounted rotatably on said footboard adjacent said front end
d. second wheel means mounted rotatably on said footboard adjacent said rear end
e. a brake element movably mounted on said footboard adjacent said rear end and positioned for braking said second wheel means
f. an element pivotted on said footboard at a position forward of said binding means
g. linkage means connected to said pivotted element and to said brake element, to permit actuation of said brake element by upward pulling movement of said pivotted element
h. means on said pivotted element for releasable engagement by a ski stick
ii. a ski stick having thereon engaging means for selectively engaging said releasable means on the pivotted element.

2. The combination of claim 1 wherein said pivotted element is a curved wire member projecting upwardly from said footboard.

3. The combination of claim 1 wherein said releasable means on said pivotted element for engagement by the ski stick is an end portion of said pivotted element formed with a slot to receive the ski stick.

4. The combination of claim 2 wherein said releasable means on said pivotted element for engagement by the ski stick is an end portion of said curved wire member formed with a slot to receive the ski stick.

5. The combination of claim 1 wherein said pivotted element is pivotted on said footboard between said binding and said first wheel means, and extends over said first wheel means.

6. The combination of claim 1 wherein said engaging means on said ski stick is a rubber member mounted at an end of the ski stick and defining at least one shoulder.

7. The combination of claim 1 wherein said engaging means on said ski stick comprises a basket on said ski stick and means secured on said ski stick and abutted by said basket to prevent movement of the basket along the ski stick.

8. The combination of claim 1 wherein said engaging means on said ski stick comprises a bearing ring secured adjacent a tip of the ski stick, and diametrically opposed barbs on said bearing ring.

* * * * *